US005469635A

United States Patent [19]

Lamontagne et al.

[11] Patent Number: 5,469,635

[45] Date of Patent: Nov. 28, 1995

[54] BABY BOTTLE DRYERS FOR MULTIPLE BOTTLES

[76] Inventors: Daniel A. Lamontagne; Jo-Ann Colantonio, both of 13 Hunter Dr., Ajax, Ontario, Canada, L1T 3M9

[21] Appl. No.: 187,202

[22] Filed: Jan. 27, 1994

[51] Int. Cl.[6] ..... F26B 25/00

[52] U.S. Cl. ..... 34/104; 34/437

[58] Field of Search ..... 34/104, 105, 106, 34/107, 21; 211/34, 437, 440

[56] References Cited

U.S. PATENT DOCUMENTS

| | | | |
|---|---|---|---|
| 2,287,765 | 6/1942 | Burnham | 34/104 |
| 2,309,290 | 1/1943 | Aksomitas | 34/104 |
| 2,365,138 | 12/1944 | Mongan, Jr. | 34/104 |
| 3,798,788 | 3/1974 | Kuntz | 34/104 |
| 4,200,993 | 5/1980 | Blanc et al. | 34/104 |
| 4,596,078 | 6/1986 | McCartney | 34/104 |
| 4,727,656 | 3/1988 | Jannach et al. | 34/104 |
| 5,010,660 | 4/1991 | Hambleton et al. | 34/104 |
| 5,249,369 | 10/1993 | Mallet | 34/104 |

*Primary Examiner*—Denise L. Gromada

[57] ABSTRACT

The baby bottle dryer comprising a base plate formed in a dish-like configuration having a flat lower surface at the central extent and curved upwardly extending side walls, a central tube extending upwardly to an extended elevation above the periphery of the base, a plurality of spaced apertures formed in the tube, the apertures having cylindrical surfaces extending upwardly from the tubular member at an angle of about 30 degrees from the horizontal, a plurality of rods, each rod being hollow with an opened first end and closed second end and with a plurality of small holes located along their length thereof, the external diameter of the being such as to be removably positioned within the apertures of the tube and adapted to receive thereon a baby bottle to be dried, a fan located in a lower extent of the tube with means to couple the fan to a source of potential, the source of potential being a pair of batteries with a switch located on the exterior surface of the tube for coupling the batteries to the fan and ports in the tube adjacent to the fan for pulling air into the tube for use in drying baby bottles on the rods.

3 Claims, 3 Drawing Sheets

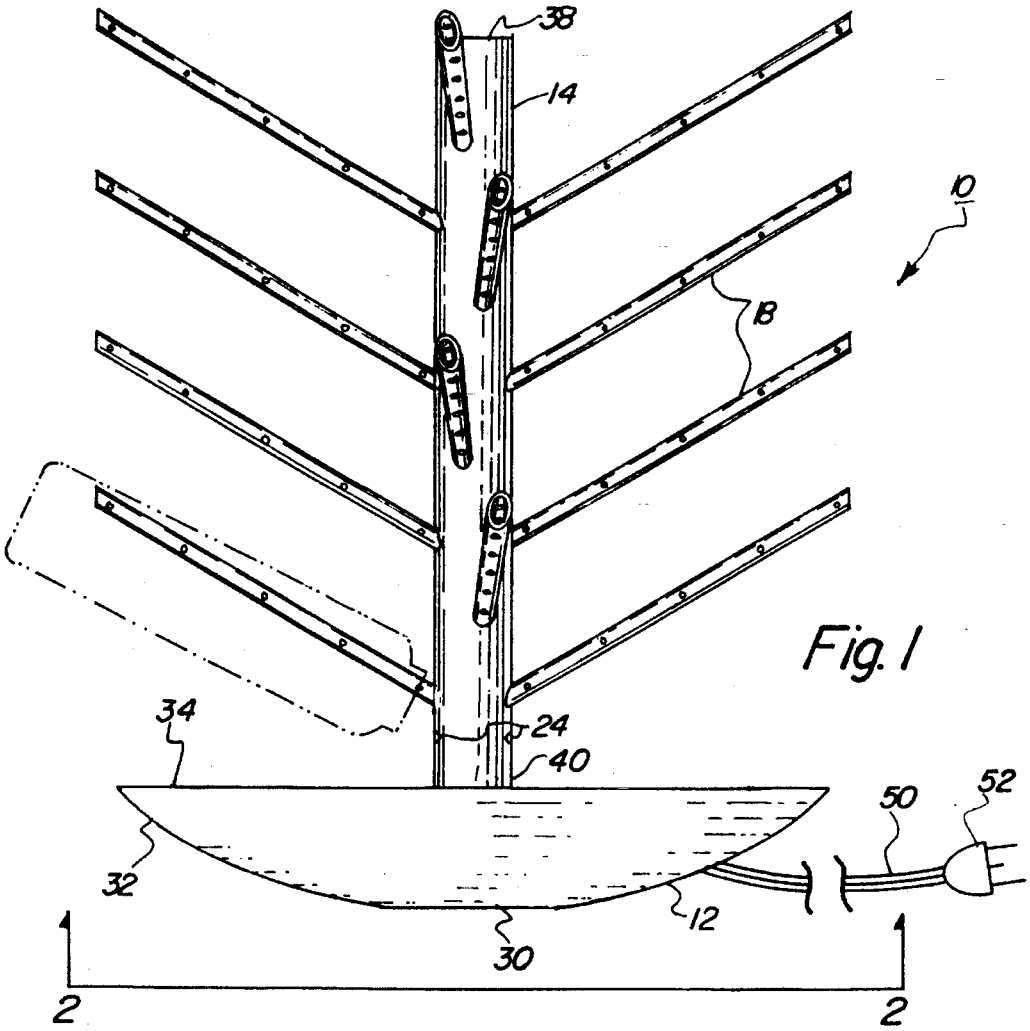
Fig. 1
Fig. 2
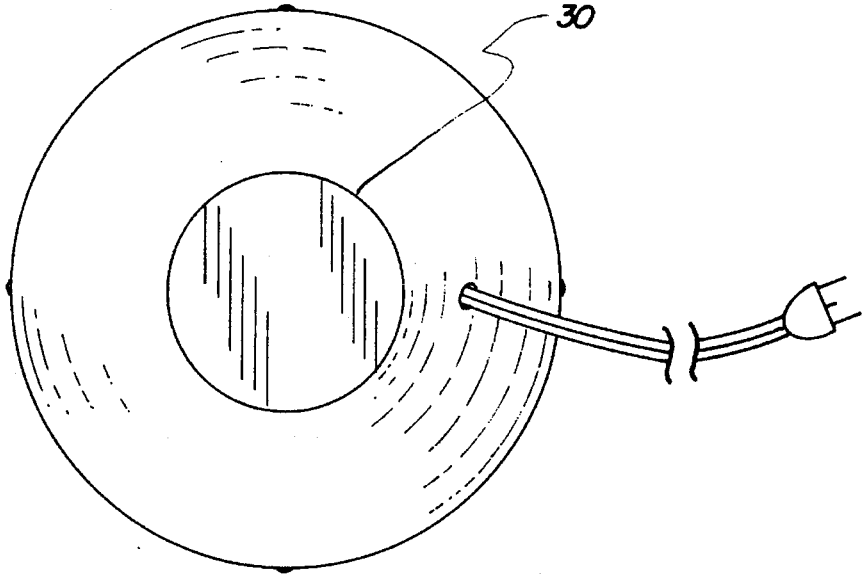

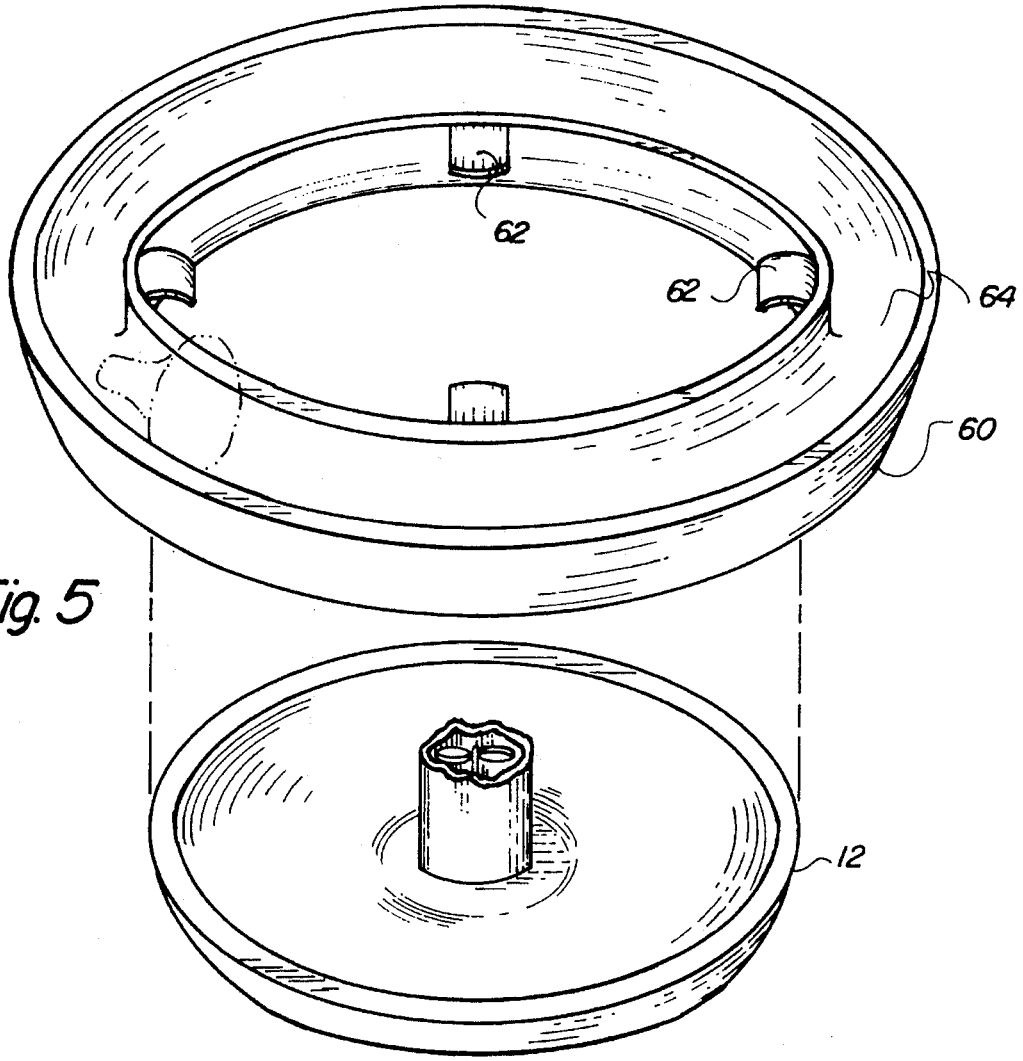
Fig. 5
Fig. 6
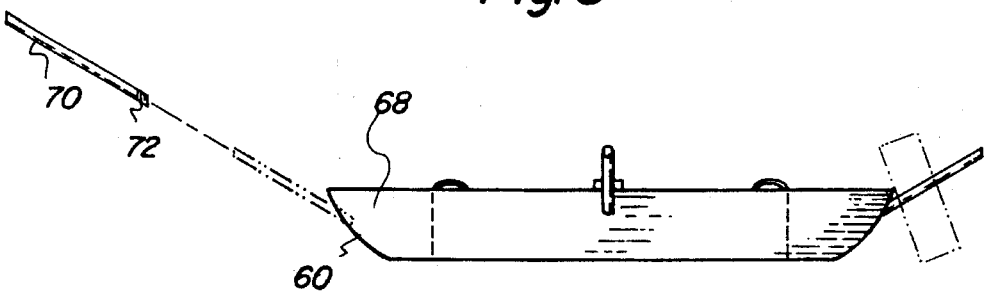

BABY BOTTLE DRYERS FOR MULTIPLE BOTTLES

BACKGROUND OF THE INVENTION

1. Field of the Invention

The present invention relates to baby bottle dryers for multiple bottles and more particularly pertains to drying a plurality of baby bottles simultaneously.

2. Description of the Prior Art

The use of nursing equipment is known in the prior art. More specifically, nursing equipment heretofore devised and utilized for the purpose of cleaning and drying baby bottles and other items are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,702,017 discloses a dryer for drying washed glass plates as they travel in a housing having an entrance slot and an exit slot and contains a conveyor having bottom members and backing elements defining a plane of travel for the glass plates.

U.S. Pat. No. 5,050,744 discloses a horizontal, elongated support structure having a transverse cross sectional shape generally similar to a truncated equilateral triangle and mounting structure is at one end for support of the elongated structure from a vertical support surface and with gated structure from a vertical support surface and with the support structure disposed generally normal to the surface.

U.S. Pat. No. 5,163,567 discloses a draining laboratory drying rack system comprising a panel having a plurality of apertures formed therein, a plurality of pegs mounted in the apertures for supporting wet laboratory equipment, a catch drain mounted to the rear of the panel to collect water dripping down the rear of the panel and drip trough to collect water from the catch drain, dripping down the front of the panel and water dripping directly from the supported laboratory equipment.

U.S. Pat. No. 5,199,188 discloses a method and apparatus for drying footwear and handwear utilizing a compartment having a blower assembly and a central tube for directing air into a tree rack for contact with the wet or damp footwear.

U.S. Pat. No. Des. 320,681 discloses an ornamental design for a baby bottle drain rack.

Finally, U.S. Pat. No. Des. 330,147 discloses an ornamental design for a container drain rack.

In this respect, the baby bottle dryer according to the present invention substantially departs from the conventional concepts and designs of the prior art, and in doing so provides an apparatus primarily developed for the purpose of drying a plurality of baby bottles simultaneously.

Therefore, it can be appreciated that there exists a continuing need for new and improved baby bottle dryer for multiple bottles which can be used for drying a plurality of baby bottles simultaneously. In this regard, the present invention substantially fulfills this need.

SUMMARY OF THE INVENTION

In view of the foregoing disadvantages inherent in the known types of nursing equipment now present in the prior art, the present invention provides an improved baby bottle dryer for multiple bottles. As such, the general purpose of the present invention, which will be described subsequently in greater detail, is to provide a new and improved baby bottle dryer for multiple bottles and method which has all the advantages of the prior art and none of the disadvantages.

To attain this, the present invention essentially comprises a new and improved baby bottle dryer for multiple bottles comprising, in combination a base plate formed in a dish-like configuration having a flat lower surface at the central extent and curved upwardly extending side walls, a central tube extending upwardly to an extended elevation above the periphery of the base, a plurality of spaced apertures formed in the tube, the apertures having cylindrical surfaces extending upwardly from the tubular member at an angle of about 30 degrees from the horizontal, a plurality of rods, each rod being hollow with an opened first end and closed second end and with a plurality of small holes located along their length thereof, the external diameter of the being such as to be removably positioned within the apertures of the tube and adapted to receive thereon a baby bottle to be dried, a fan located in a lower extent of the tube with means to couple the fan to a source of potential, the source of potential being a pair of batteries with a switch located on the exterior surface of the tube for coupling the batteries to the fan, ports in the tube adjacent to the fan for pulling air into the tube for use in drying baby bottles on the rods, a removable cap at the lower central extent of the base for providing access for changing the batteries, a supplemental base plate in a ring-like configuration for supporting nipples to be dried with attachment components for coupling to the base plate and a plurality of dowels secured to the supplemental base plate for supporting nipple rings to be dried.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved baby bottle dryers for multiple bottles which have all the advantages of the prior art nursing equipment and none of the disadvantages.

It is another object of the present invention to provide new and improved baby bottle dryers for multiple bottles which may be easily and efficiently manufactured and marketed.

It is further object of the present invention to provide new and improved baby bottle dryers for multiple bottles which are of durable and reliable construction.

An even further object of the present invention is to provide new and improved baby bottle dryers for multiple bottles which are susceptible of a low cost of manufacture with regard to both materials and labor, and which accordingly is then susceptible of low prices of sale to the consuming public, thereby making such baby bottle dryers for multiple bottles economically available to the buying public.

Still yet another object of the present invention is to provide new and improved baby bottle dryers for multiple bottles which provide in the apparatuses and methods of the prior art some of the advantages thereof, while simultaneously overcoming some of the disadvantages normally associated therewith.

Still another object of the present invention is to dry a plurality of baby bottles simultaneously.

Lastly, it is an object of the present invention to provide a new and improved baby bottle dryer for multiple bottles comprising a base plate formed in a dish-like configuration having a flat lower surface at the central extent and curved upwardly extending side walls, a central tube extending upwardly to an extended elevation above the periphery of the base, a plurality of spaced apertures formed in the tube, the apertures having cylindrical surfaces extending upwardly from the tubular member at an angle of about 30 degrees from the horizontal, a plurality of rods, each rod being hollow with an opened first end and closed second end and with a plurality of small holes located along their length thereof, the external diameter of the being such as to be removably positioned within the apertures of the tube and adapted to receive thereon a baby bottle to be dried, a fan located in a lower extent of the tube with means to couple the fan to a source of potential, the source of potential being a pair of batteries with a switch located on the exterior surface of the tube for coupling the batteries to the fan and ports in the tube adjacent to the fan for pulling air into the tube for use in drying baby bottles on the rods.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an elevational view of new and improved baby bottle dryers for multiple bottles constructed in accordance with the principles of the present invention.

FIG. 2 is a bottom view of the device shown in FIG. 1 taken along lines 2—2 of FIG. 1.

FIG. 5 is an exploded perspective view of a base constructed in accordance with an alternate embodiment of the invention.

FIG. 6 is a side elevational view of the base shown in FIG. 5 but with threaded dowels included to constitute another alternative embodiment of the invention.

The same reference numerals refer to the same parts through the various Figures.

DESCRIPTION OF THE PREFERRED EMBODIMENT

Figure 3:
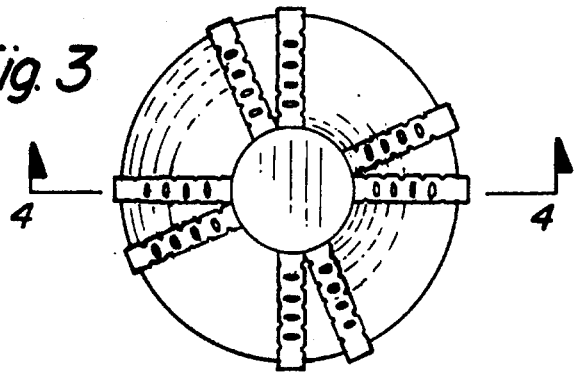
FIG. 3 is a plan view of the device shown in the prior Figure.

With reference now to the drawings, and in particular to FIG. 1 thereof, the preferred embodiment of the new and improved baby bottle dryer for multiple bottles embodying the principles and concepts of the present invention and generally designated by the reference numeral 10 will be described.

Specifically, it will be noted in the various Figures that the present invention is a system 10 which, in its simplest terms, includes a base plate 12, a central tube 14, a plurality of spaced apertures formed in the tubes, a plurality of hollow rods 18 with small holes 20, a fan 22 located within the lower extent of the tube, ports 24 in a lower extent of the tube 14 and a switch 26 for energizing and de-energizing the fan. The various parts are configured individually and with respect to each other to attain the desired objective.

More specifically, the base plate 12 is formed in a dish-like configuration. It has a flat lower surface 30 at its central extent. This provides stability to the plate 12 and system 10 when in operation and use. The bottom of the base plate is curved upwardly from the central extent to constitute side walls 32 and terminates at its upper extent at the periphery 34 of the base plate. The base plate forms a hollow dish-like opening 36 for catching drips of water which may fall therein as will be understood from the descriptions provided hereinafter.

The next major component of the system is the central tube 14. The tube is a hollow member having a closed upper end 38 and an opened lower end 40. This allows for the flow of air upwardly from the bottom of the tube. Apertures 20 are formed in the sides of the tube. In the preferred embodiment, four such apertures 20 are provided along the length of the tube at four separate elevational locations. In addition, four such apertures 20 are provided around the periphery of the tube at generally equally spaced integral of about 90 degrees. This allows a total of sixteen symmetrically spaced apertures in the tube. Variations in the numbers of apertures and their locations are within the discretion of the user and manufacturer. Such apertures are all generally spaced above the upper periphery of the base plate.

Next provided are a plurality of rods 18. Each rod is hollow with an opened first end 44 and a closed end 46. Such rods are adapted to be positioned within the spaced apertures 20 with the apertures angled to position the rods at an angle of about 30 degrees upward from the horizontal.

A plurality of small holes 20 are located along the length of the rods. The external diameter of the rods is such as to be removably positioned within the apertures of the tube. Such diameter is also sufficient so as to receive thereon a baby bottle to be dried, one on each rod.

Figure 4:
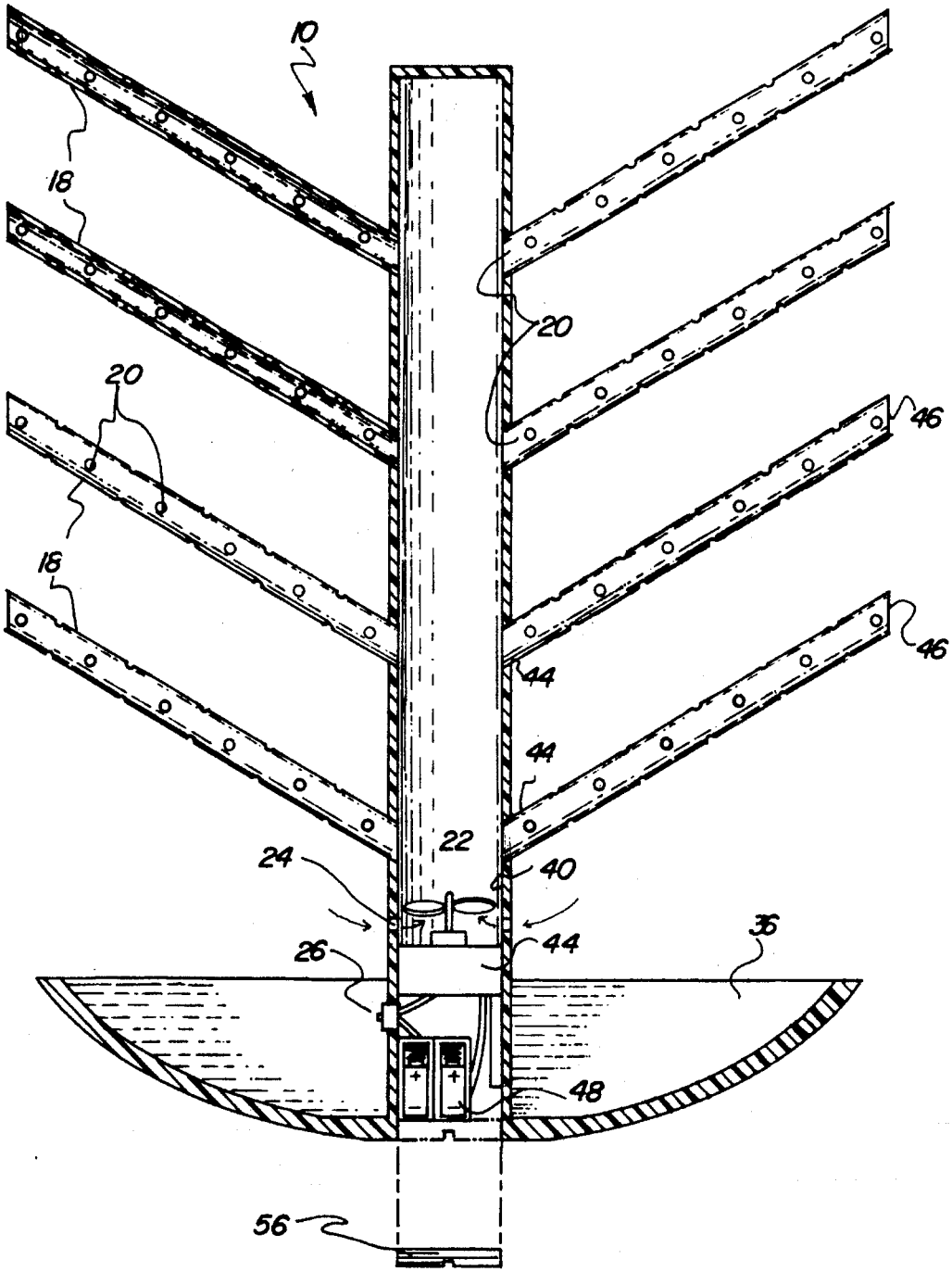
FIG. 4 is a cross-sectional view taken along lines 4—4 of FIG. 3.

A fan 22 constitutes the next component of the system. Such fan 22 is located in the lower extent of the tube 14. Its blades are configured to direct a flow of air upwardly from the lower end of the tube to the closed upper end. The fan is coupled through a motor 44 to a switch 26 which is in turn coupled to a source of potential. The source of potential is shown as a pair of batteries 48 in one embodiment. Note FIG. 4. In the other embodiment, the source of potential for the motor 44 is an electrical line 50 couplable by a plug 52 into a conventional wall outlet with alternating current. Note FIGS. 1 and 2. In either embodiment, however, a switch 26 is preferably provided on the exterior surface of the tube near a lower extent thereof for activating the fan to direct a flow of air through the tube and rods and then through holes 20 for drying baby bottles located thereon.

In either embodiment, ports 24 are formed in the tube adjacent to the fan for pulling air from the atmosphere into the tube for being propelled on its path of travel for use in drying the baby bottles positioned on the rods. In the embodiment employing the batteries, a cap 56 is provided for being screwed into the central extent of the base to preclude inadvertent wetting of the batteries and the motor. A similar cap may be provided in the embodiment of FIGS. 1 and 2 to allow for entry and access to the motor and fan for the purpose of replacement and repair. Such removable cap 56 also allows for changing of the batteries as may be required through time.

FIG. 5 illustrates an alternate embodiment of the invention. In such alternate embodiment, a supplemental base plate 60 is provided. Such supplemental base plate is in a ring-like configuration with an interior diameter slightly larger than the exterior diameter of the base plate 12 of the embodiment of the prior figures. Attachment components 62 are provided in the form of clips adapted to rest over the periphery of the base plate 12. The supplemental base plate is provided with a dish-like central section 64 for receiving and supporting nipples to be dried.

The last feature of the present invention is a further alternate embodiment. As can be seen in FIG. 6, the supplemental base plate 60 is provided with threaded apertures 68 at spaced locations around its external periphery. Attachable to such threaded apertures 68 are dowels 70 with threads 72 at their internal end. Such threads 72 are adapted to be removably coupled to the threaded apertures 68 in the supplemental base plate. By having such threaded dowels extend upwardly at an angle of about 30 degrees, they are readily adapted to support nipple rings for drying.

Wet baby bottles are suspended on arms of the dryer. A small fan blows air into the bottles drying them. While the bottles are suspended any excess water drips into the support base which acts as a basin. The fan can be battery operated or used with an adaptor.

What is claimed as being new and desired to be protected by Letters Patent of the United States is as follows:

1. A baby bottle dryer comprising, in combination:

a base plate formed in a dish-like configuration having a flat lower surface at the central extent and curved upwardly extending side walls;

a central tube extending upwardly to an extended elevation above the periphery of the base;

a plurality of spaced apertures formed in the tube, the apertures having cylindrical surfaces extending upwardly from the tubular member at an angle of about 30 degrees from the horizontal;

a plurality of rods, each rod being hollow with an opened first end and closed second end and with a plurality of small holes located along their length thereof, the external diameter of the rods being such as to be removably positioned within the apertures of the tube and adapted to receive thereon a baby bottle to be dried;

a fan located in a lower extent of the tube with means to couple the fan to a source of potential, the source of potential being a pair of batteries with a switch located on the exterior surface of the tube for coupling the batteries to the fan;

ports in the tube adjacent to the fan for pulling air into the tube for use in drying baby bottles on the rods;

a removable cap at the lower central extent of the base for providing access for changing the batteries;

a supplemental base plate in a ring-like configuration for supporting nipples to be dried with attachment components for coupling to the base plate; and a plurality of dowels secured to the supplemental base plate for supporting nipple rings to be dried.

2. A baby bottle dryer comprising:

a base plate formed in a dish-like configuration having a flat lower surface at the central extent and curved upwardly extending side walls;

a central tube extending upwardly to an extended elevation above the periphery of the base;

a plurality of spaced apertures formed in the tube around the periphery thereof, the apertures having cylindrical surfaces extending upwardly from the tubular member at an angle of about 30 degrees from the horizontal;

a plurality of rods, each rod being hollow with an opened first end and closed second end and with a plurality of small holes located along their length thereof, the external diameter of the rods being such as to be removably, positioned within the apertures of the tube and adapted to receive thereon a baby bottle to be dried;

a fan located in a lower extent of the tube with means to couple the fan to a source of potential, the source of potential being a pair of batteries with a switch located on the exterior surface of the tube for coupling the batteries to the fan;

ports in the tube adjacent to the fan for pulling air into the tube for use in drying baby bottles on the rods; and a supplemental base plate in a ring-like configuration for supporting nipples to be dried with attachment components for coupling to the base plate.

3. A drier as set forth in claim 2 and further including a plurality of dowels secured to the supplemental base plate for supporting nipple rings to be dried.

* * * * *